United States Patent [19]

Parker et al.

[11] Patent Number: 4,822,310

[45] Date of Patent: Apr. 18, 1989

[54] REMOVABLE STIRRUP FOR WATER SKIS

[76] Inventors: Timothy A. Parker, 352 N. Banff, Tucson, Ariz. 85748; Colleen A. Jones, 3630 S. Logan, Tucson, Ariz. 85730

[21] Appl. No.: 138,144

[22] Filed: Dec. 28, 1987

[51] Int. Cl.[4] ..... A63C 15/06

[52] U.S. Cl. ..... 441/70

[58] Field of Search ..... 114/39.1, 39.2; 441/67–75; 280/607, 611, 614, 615, 618, 620, 627

[56] References Cited

U.S. PATENT DOCUMENTS

| | | | |
|---|---|---|---|
| 3,173,161 | 3/1965 | Amsbry | 441/70 |
| 3,201,807 | 8/1965 | Weaver | 441/79 |
| 3,571,832 | 3/1971 | Rauch | 441/70 |
| 3,626,529 | 12/1971 | Schreck | 441/73 |
| 4,028,760 | 6/1977 | Tarlton | 441/70 |
| 4,227,274 | 10/1980 | Richardson | 441/68 |
| 4,645,466 | 2/1987 | Ellis | 114/39.2 |

*Primary Examiner*—Sherman D. Basinger
*Assistant Examiner*—Jesûs D. Sotelo
*Attorney, Agent, or Firm*—J. Michael McClanahan

[57] ABSTRACT

A removable stirrup for water skis adapted to be placed upon the top surface of the ski and to be removed therefrom with a minimum of effort. The removable stirrup comprises a rectangularly shaped flat surface base having a non-slip textured upper surface with a pair of padded straps rising up from upper surface, the straps adapted to receive the front portion of a skier's foot. Attached on opposite sides of the elongated rectangular base are downward extending cupped lips adapted to extend below the sides of the ski and inwardly on the bottom of the ski. A pair of compression screws reside in threads formed transversely through the flat base. The removable stirrup is slipped on to the ski from the front up-turned section by sliding the side edges of the ski between the oppositely located cupped lips to a position immediately forward the standard fixed boot attached to the ski. The removable stirrup is held to the ski by clamping the ski between the lower portion of the curved lip and the compression screw situated in the base. In an alternate embodiment, straps attached to the base are modified to a toe portion or a toe and heel portion to constitute a removable boot.

12 Claims, 2 Drawing Sheets

REMOVABLE STIRRUP FOR WATER SKIS

BACKGROUND OF THE INVENTION

1. Field of the Invention.

The field of the invention is devices providing boots, foot holds, or stirrups for skiers on water skis.

2. Description of the Related Art.

Water skiing has been popular for a number of years and water skis have been available for the skiers, both adult and child. Water skis typically are furnished with a permanently mounted boot or stirrup thereon, the boot consisting of a toe section and a heel section with both sections being made out of flexible rubber. The stirrup may consist of a pair of straps mounted to the ski. The boot is fastened to the top surface of the skis by tacking a peripheral extending flat edge of the boot to the top surface of the ski with small nails, screws, rivets or the like. Obviously, an adult boot is larger than a child's boot since the boot must conform generally to the person's foot for a satisfactory fit in order to keep the skis on, however there are boots with adjustable heel portions which permit some flexibility in size.

It is known to have more than one skier riding one or more skis and Tarlton, Jr., in U.S. Pat. No. 4,028,760, discloses a double slalom ski designed for a pair of skiers, the ski characterized by having one full permanent boot with toe portion and heel portion together with a plurality of additional foot straps to receive the forward portion of both the skiers' remaining feet.

In addition, Rauch, in U.S. Pat. No. 3,571,832, describes an aquatic amusement device having some similarities to a slalom ski, containing a plurality of fixed boots or stirrups upon the device.

While multiple skiers on one ski or for that matter, a pair of skis, are known, the problem of providing means whereby two skiers could ride on one or a pair of standard one-skier skis has not been addressed. In all cases known to the Inventors, boots to receive multiple skiers upon one or two skis incorporate permanent attachments to the water skis which obviously renders the skis useful substantially only for dual skiers (of course, it is possible for one skier to use the skis).

Accordingly, it would be helpful if devices were available which provided removable boots or stirrups for the water skis, the removable boots or stirrups adapted to provide either the sole boot or stirrup on each ski or to be an added boot or stirrup to the existing permanently placed boot. This would be extremely helpful in the case of an adult skier taking a child along with him on his standard skis to help the child learn balance in beginning to water ski.

SUMMARY OF THE INVENTION

This invention relates to a removable stirrup and boot for water skis adapted to be the sole stirrup or boot on a water ski, or to be a second stirrup or boot on water skis in addition to the permanently attached boot.

To this end, the removable boot and stirrup is constructed having an elongated rectangular flat thin base adapted to receive the foot of the skier with the base top surface comprising a textured non-slip surface for the bottom of the skier's foot. Along the elongated rectangular opposite sides of the base is a rolled over, curved lip adapted to encompass opposite side edges of the water skis and a portion of the underside or bottom of the skis. The curved lip portion of the removable base, together with a compression screw in the base, comprise the means by which the base is removably attached to the ski. This compression screw, of which there are two located in the forward portion of the flat base, resides in threads formed transversely to the top surface of the base and through the base. The bottom of the screw urges against a rubber pad which directly contacts the top flat surface of the ski. The other end of the screw has a screwdriver slot. Thus a clamping action is formed between the screw and the curved lip with the ski in between.

The removable stirrup contains a pair of straps which rise up from the top textured surface of the base to encompass the forward portion of the foot of the skier, the straps fastened together by means of Velcro attached at each end. The straps may be broadened and modified to form a toe portion, or a toe and heel portion, the removable stirrup now taking the form of a removable boot.

The removable base is slid on to the water ski from the front upturned portion to a position preferably just immediately forward of the permanent boot. Then the compression holding screws are rotated with a screwdriver until they have substantially engaged the top of the skis. The base is now held in place.

Other embodiments of the invention include the addition of Velcro or other removable type fastening materials attached to both the underside of the base and the top surface of the ski as a different means of fastening or holding the removable stirrup or boot to the ski.

It is an object of the subject invention to provide a removable stirrup or boot for attachment to water skis.

It is another object of the subject invention to provide a removable stirrup or boot which is secured to water skis by compressing the skis in a clamping mechanism incorporated into the removable stirrup or boot.

It is still another object of the subject invention to provide removable stirrup or boot for water skis having foot holding means including straps, or toe portions, or toe and heel portions.

It is still another object of the subject invention to provide a removable stirrup or boot for water skis utilizing various means of securing the removable stirrup or boot to the water ski.

Other objects of the invention will in part be obvious and will in part appear hereinafter. The invention accordingly comprises the apparatus and method comprising the construction, combination of elements, and arrangement of parts which are exemplified in the following detailed disclosure, and the scope of the Application which will be indicated.

DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
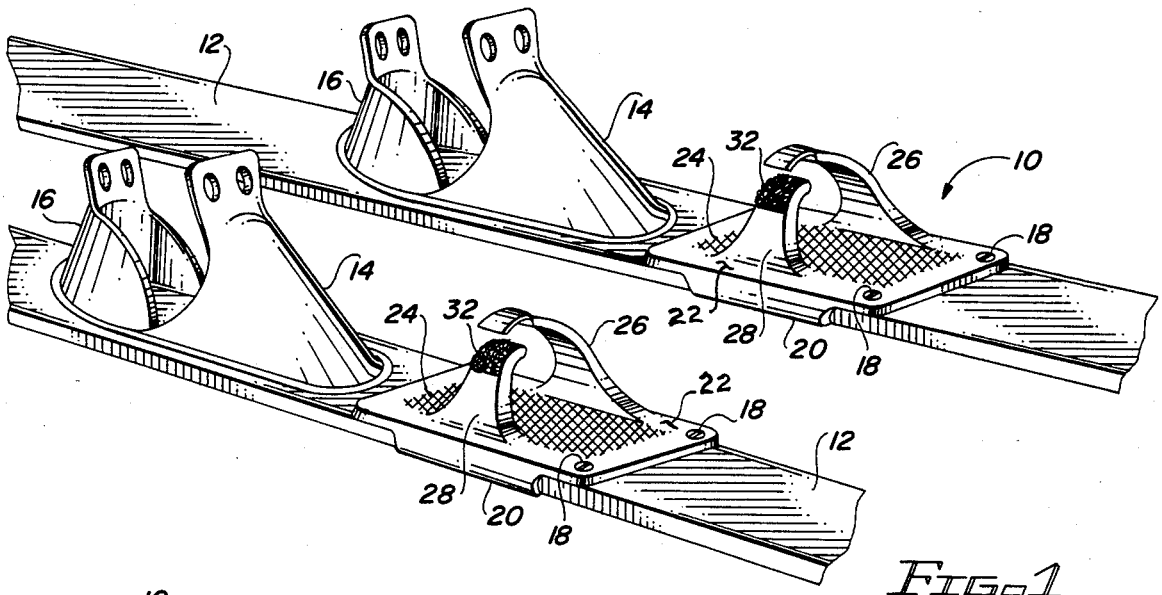
FIG. 1 is a perspective view of the subject device in place upon a pair of water skis.

Referring now to FIG. 1, a perspective view of the inventive removable stirrup for water skis is shown attached to a pair of adult skis. In the configuration detailed, the removable stirrups may serve the purpose of permitting a child to ski with an adult, the child situated immediately in front of the adult with the child's feet inserted into the straps of the removable stirrups. Firstly, removable stirrup 10 is shown located on adult skis 12 immediately forward of the permanently attached boot comprising adult toe portion 14 which is followed by the attached adult heel portion 16. The means to removably secure base 22 of stirrup 10 to ski 12 by clamping consists of a pair of compression screws 18 urged down upon ski 12 and cupped lip 20 extending immediately below the sides of ski 12 to receive a portion of the bottom of the ski. Cupped lip 20 is located on opposite sides on flat elongated rectangular base member 22 and is approximately two-thirds of the length of the sides. Immediately atop base 22 of removable stirrup 10 is a textured non-slip surface 24 (such as latex rubber) upon which the child's bare foot rests. Lastly, emerging up from the sides of base 22 are the means to removably secure the skier's foot to base 22, namely oppositely located fastening straps 26 and 28, strap 26 having an extension to overlap the top portion of strap 28. Attached to the bottom side of strap 26 is a short piece of Velcro (not shown) which is adapted to mate with a second piece of Velcro 32 located on the outside portion of strap 28. In addition, it is obvious that the width of base 22 must be at least equal to, and preferably slightly larger than the width of ski 12 in order that the opposite attached cupped lips 20 may receive the sides of the ski.

The preferable procedure for use of removable stirrup 10 is that base 22 is slipped down over the water ski from the front up-turned portion to ride atop the ski with the cupped lip underneath the ski until the rear portion of base 22 is proximate the front portion of adult boot toe 14. Base 22 need not contact adult boot toe 14. At this point, compression screws 18 embedded in base 22 are utilized by turning a quarter turn or so, the lower portion of compression screws 18 being fitted with a rubber pad which engages the top portion of ski 12 and, in combination with the holding action of cupped lip 20, secures the ski in between screw 18 and cupped lip 20.

After the removable stirrups are placed upon the skis, they are ready for use by the passenger, either a child or an adult. The primary adult places their feet in the boot toe 14, the heel of the adult being secure against the heel 16 shown in FIG. 1. The adult or child passenger then places each foot under the two straps 26 and 28 for two skis and strap 26 is then pulled over the child's foot in a secure manner and fastened to the other strap 28 by means of the coaction between the two Velcro strips. At this point, the primary or driver adult, who will hold the rope attached to the speed boat, is ready then to be pulled by the rope and bring the skis up onto the surface of the water in order that both the adult and child may enjoy water skiing on the same skis.

Figure 2:
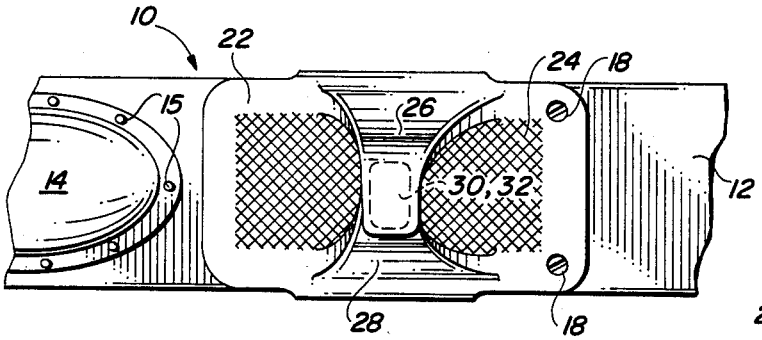
FIG. 2 is a top view of the device in place upon a water ski.

Referring now to FIG. 2, a top view of one of the skis 12 is shown with the removable stirrup 10 in place proximate the front portion of boot toe 14, boot toe 14 being shown with its means permanently attaching its peripheral edge to ski 12, namely the screws, rivets or other fastening means 15. Seen immediately on removable stirrup 10 is the base 22 covered in a large portion by textured surface 24 and with the pair of straps, namely overlapping strap 26 and its opposite, strap 28. The screwdriver slot of compression screws 18 are shown in the forward portion of base 22.

Figure 3:
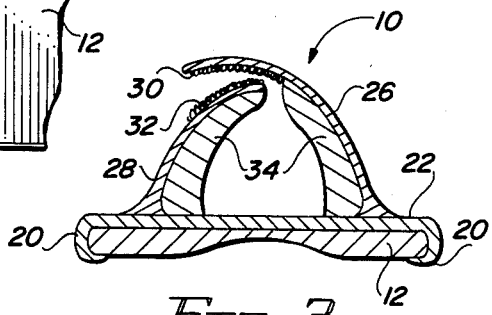
FIG. 3 is a cross-sectional view of the device taken through the foot holding straps.

Next, proceeding to FIG. 3, a cross-sectional view of the removable stirrup 10 taken through straps 26 and 28 of FIG. 2 is detailed. Firstly, starting from the bottom, ski 12 is shown in cross-sectional view showing the centrally located longitudinal slot or tunnel which provides lateral stability to the ski. Immediately above ski 12 is base 22 of removable stirrup 10. Attaching to opposite sides of base 22 of stirrup 10 is cupped lips 20 encompassing both the sides and a portion of the bottom of ski 12. Next, attached to the base 22 of stirrup 10 are the foot receiving straps 26 and 28 and their respective Velcro pieces, namely Velcro piece 30 attached to the underside of strap 26 and Velcro piece 32 attached to the upper side of strap 28. Immediately inside both sides of straps 26 and 28 is soft padding 34, padding 34 adapted to be that portion of the strap that immediately contacts the sides and the top of the child's foot in order to prevent chafing or injury to the foot.

Figure 4:
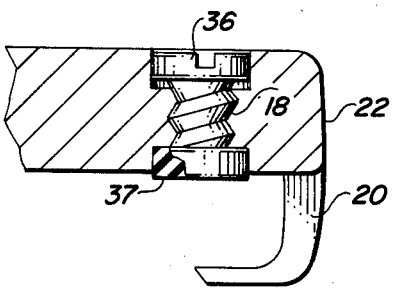
FIG. 4 is a diagramic illustration of the portion of the device detailing the clamping mechanism.

Referring now to FIG. 4, a diagramic portion of base 22 is shown in order to illustrate the means by which the base 22 is held to ski 12, namely compression screw 18 in combination with cupped lip 20. Compression screw 18 is a rather large screw designed so that with a minimum of turning, normally one-quarter turn, the screw will advance sufficient distance to firmly engage the top of ski 12. Threads formed in base 22 accomodate the threads of screw 18. At the lower portion of screw 18 is rubber pad 37 which forcibly engages the top of ski 12 to compress ski 12 between itself and the lower portion of cupped lip 20. At the upper portion of screw 18 is it's head 36, nominally having a slot adapted to receive a coin on its side to be used as a screwdriver. Of course, a screwdriver will also work. The threads in base 22 are so formed, together with screw 18, that when screw 18 is rotated into its compression position, the top surface of screw head 36 is either level with or slightly below the surface of base 22.

Thus, in accordance with the description of the use of the device following the discussion of FIG. 1, it may be easily seen how all the parts of the device work together to accomplish the desired result. Of course, sufficient distance must be allowed between the upper surface of the cupped portion of lip 20 and the lower surface of base 22 so that the removable base slides easily over the ski 12 in order that the foot may be easily emplaced or removed as desired. Because most water skis have a slightly curved upward front part, it may be necessary to provide a somewhat larger distance between the upper portion of the cupped lip 20 and the lower portion of base 22 then would be necessary if the skis did not have a front curve portion. In addition, the width of removable base 22 must be such to slide over the widest portion of ski 12 that removable stirrup 10 will encounter.

Figure 5:
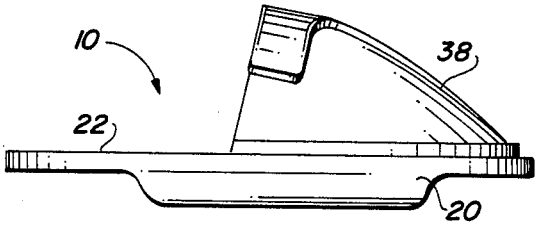
FIG. 5 is a side view of an alternate embodiment of the device.
Figure 6:
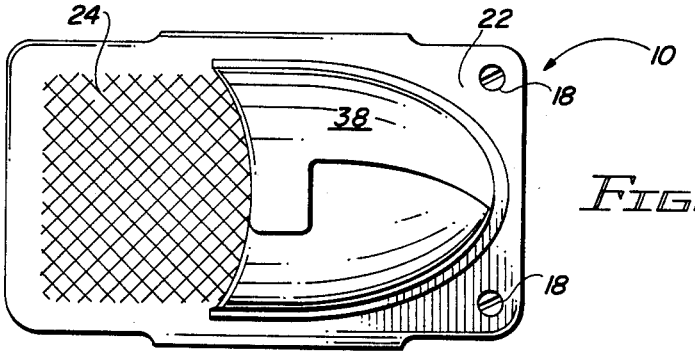
FIG. 6 is a top view of the alternate embodiment of the device shown in FIG. 5.

Other variations of the invention which still embody the primary concept are shown in the continuing drawings, FIG. 5–10. For example, FIGS. 5 and 6 show the invention with straps 26 and 28 broadened and modified to a front toe portion 38 designed to totally enclose the toes and front portion of the passenger's feet, operating much as the adult boot toe portion 14. FIG. 5 is a side view of the alternate embodiment and FIG. 6 is a top view of the same alternate embodiment shown in FIG. 5. The remainder of the invention remains the same, still employing base 22 and cupped lips 20 attached to base 22 and adapted to engage the bottom of the ski. Similarly, the bottom of base 22 still has the textured surface 24 and the compression screws 18 are still in evidence.

Figure 7:
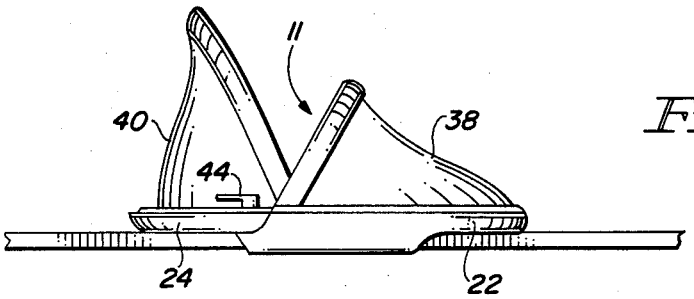
FIG. 7 is a side view of another alternate embodiment of the device.

Another variation of the subject invention is shown in FIG. 7 where the straps 26 and 28 have been further broadened and modified to include heel portion 40 to receive the heel of the passenger child's foot and form a complete removable boot 11. In fact, if desired, heel portion 40 may be mounted upon a slidable plate 42 which slides on top of base 22 to adjust the distance between the toe portion 38 and the heel portion 40 to provide a larger or smaller foot receptor. The slidable plate 42 may be secured by means of a rotatable lever 44 which secures slidable plate 42 to base 22. Boots with adjustable heels are very common in the art and need not be further discussed except to say that the toe portion with the adjustable heel is mounted upon base 22 rather than upon the usual place, i.e., ski 12.

It is now obvious from FIGS. 1 through 7 that the invention need not be a complimentary stirrup or boot to the standard boot portions 14 and 16 shown in FIG. 1. In fact, the removable stirrup or boot 10 may be the sole stirrup or boot on a water ski whereby the skis are purchased having no permanent boot affixed, but would be purchased much as snow skis are, i.e., without any bindings, the bindings to be later added. Thus, removable stirrup 10 or boot 11 can be the sole boot on the skis and thus obviously provide for various and different placements upon the ski itself. For younger children, it may be desirable to place the removable stirrup 10 or boot 11 forward of the normal position where boots are normally placed upon skis and thus allow a child to use adult sized skis.

Figure 8:
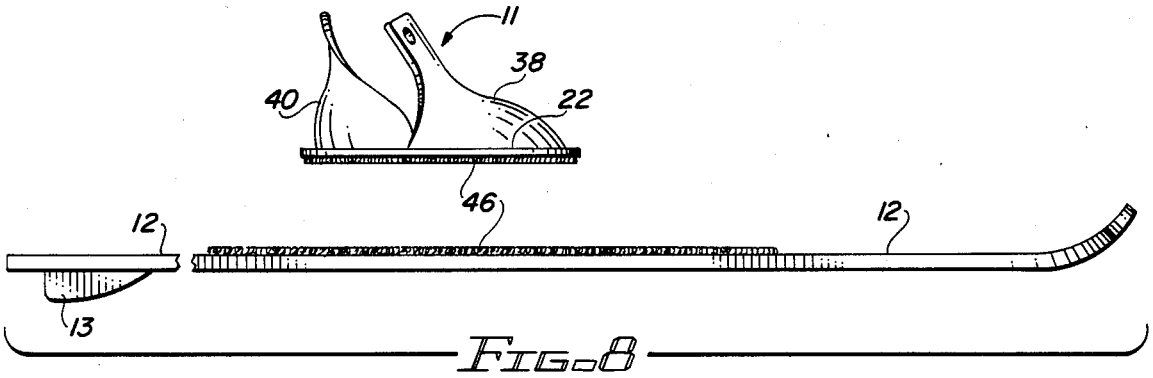
FIG. 8 is another alternate embodiment of the device.

Enlarging on the theme of FIG. 7, FIG. 8 shows the subject removable boot 11 having both a toe portion 38 and heel portion 40 attached to base 22 with base 22 now being attached to ski 12 by the means of two Velcro fastening strips 46, one attached to the bottom of base 22 and one attached to the top of ski 12. Thus, through the means of popularly available Velcro fastenings, the removable boot 11 may be easily attached to, and removed from, the skis. Naturally, in the removable boot shown in FIG. 8, the cupped lip portion 20 shown in the embodiments of FIGS. 1 through 7, has been removed as there is no longer a need for the same. Also obviously, compression screw 18 is no longer needed either. Additionally in FIG. 8, shown at the rear of ski 12 is skag or rudder 13 as it is normally present on water skis to provide lateral stability.

Figure 9:
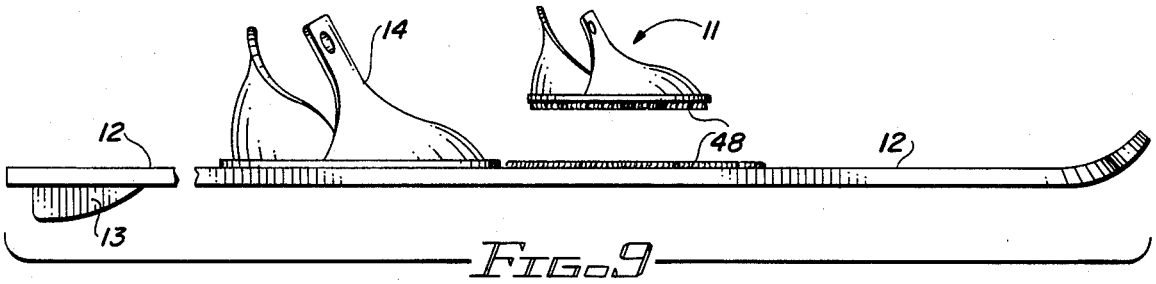
FIG. 9 is a side view of a variation of the alternate embodiment shown in FIG. 8.

Referring now to FIG. 9, the concept embodied in FIG. 8 is immediately transferred to the passenger's removable boot 11 for placement upon the adult ski having the already permanently attached boot portions 14 and 16. Here again, Velcro strips 48 are utilized to attach removable boot 11 to the adult ski, the strips similarly attached to removable boot 11 and ski 12 as described in connection with FIG. 8. As in FIG. 8, the removable boot 11 shown in FIG. 9 does not have nor need the cupped lip 20 portion nor the compression screws 18.

Figure 10:
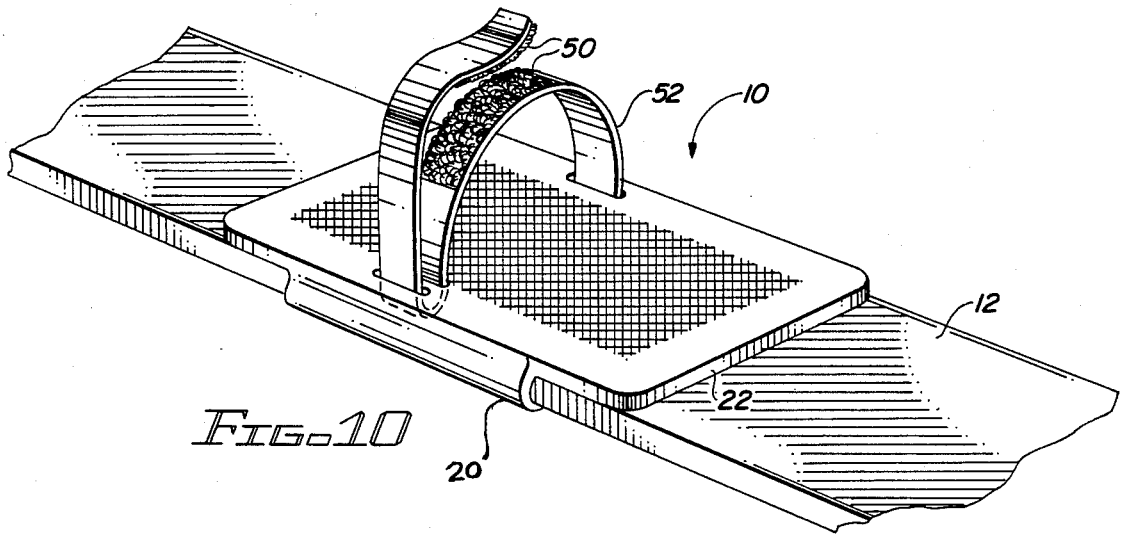
FIG. 10 is a still further alternate embodiment of the device showing a different arrangement for the foot holding strap.

Lastly, FIG. 10 details a simplified embodiment of the invention where the straps 26 and 28 of FIGS. 1–3 have been replaced by a single strap 52, strap 52 attaching at one side of base 22, then rising up to travel to the other side of base 22 where it dives into base 22 and comes back out of the tunnel formed in base 22. The strap 52 then comes back upon itself to engage Velcro strips 50 located at two areas on strip 52 and thus hold the strap at its desired position.

In the preferred embodiments, and in the alternate embodiments shown, the invention was preferably made of injected molded plastic and as one piece except for the compression screws, the Velcro strips, and the rubber pads attached to the compression screws. The compression screws were also preferably made from a rust proof metal, such as aluminum. It is obvious that the base could also be separately manufactured, such as by molding, and that the straps which extend from the base may comprise separate materials attached to the base by appropriate means such as an adhesive, riveting, or the like.

It is obvious that a pair of removable stirrups or boots may be placed in tandem upon one ski in order to use that ski as a double slalom ski.

While a preferred embodiment of the invention, together with multiple alternate embodiments has been shown and described, it will appreciated that there is no intent to limit the invention by such disclosure. Accordingly, the disclosure is intended to cover all modifications and alternate embodiments falling with the spirit and the scope of the invention as defined in the appended claims.

We claim:

1. A removable stirrup for attachment to a water ski to receive and secure a skier's foot comprising:

a removable base having a top surface adapted to receive the skier's foot;

means to removably secure said base to the associated ski defining means to clamp said base to the ski, said clamp means including a first rolled over cupped lip attached to said base, said cupped lip adapted to extend over the ski to receive a portion of the ski within said cupped lip; and means to removably secure the skier's foot to said base whereby the skier is secured to the ski by the skier's foot secured to the base and the base secured to the ski in order that the skier may utilize the water ski.

2. The removable stirrup as defined as claim 1 wherein said means to clamp said base to the ski further includes a first compression screw operably attached to said base, said compression screw adapted to be forcefully urged against the ski whereby the ski is clamped between said cupped lip and said compression screw.

3. The removable stirrup as defined in claim 2 wherein said means to clamp said base to the ski includes a second rolled over cupped lip, said first and second rolled over cupped lips oppositely attached to said base, said cupped lips adapted to receive the ski between them.

4. The removable stirrup as defined in claim 3 wherein said means to clamp said base to the ski includes a second compression screw operably attached to said base, said first and second compression screws oppositely operably attached to said base whereby said compression screws may be operated to clamp the ski between said cupped lips and said compression screws, and the base may be removed from the ski by operating said compression screws to release the clamp of the ski between said cupped lips and said compression screws.

5. The removable stirrup as defined in claim 4 wherein said compression screws define screws embedded in said base, said screws having longitudinal axis transverse to said surface of said base, and said screws having rubber pads mounted thereto, said rubber pads adapted to engage the ski.

6. A removable stirrup for attachment to a water ski to receive and secure a skier's foot comprising:

a removable base having a top surface adapted to receive the skier's foot, said base defining a flat elongated rectangular member having a textured non-slip top surface;

means to removably secure said base to the ski, said means including a pair of Velcro fastening strips, one of said Velcro fastening strips attached to said base and the other of said Velcro fastening strips attached to the ski; and means to removably secure the skier's foot to said base whereby the skier is secured to the ski by the skier's foot secured to the base and the base secured to the ski in that the Velcro fastening strips may be brought together to secure said base to the ski and may be separated to remove said base from the ski in order that the skier may utilize the water ski.

7. The removable stirrup as defined in claim 6 wherein said means to removably secure the skier's foot to said base includes a pair of fastening straps attached to said base, said straps together with said base encircling and fastening around the skier's foot.

8. The removable stirrup as defined in claim 7 wherein said pair of fastening straps include padding attached to said straps, said padding adapted to be interposed between said straps and the skier's foot.

9. The removable stirrup as defined in claim 8 wherein said pair of fastening straps further include a pair of Velcro fastening strips, one of each pair of said fastening strips, one of each pair of Velcro fastening straps attached to one of each pair of said fastening straps whereby the fastening straps may be fastened to each other to secure the skier's foot, and the fastening straps separated to permit removal of the skier's foot.

10. The removable stirrup as defined in claim 6 wherein said means to removably secure the skier's foot to said base includes a toe portion attached to said base, said toe portion adapted to receive a part of the skier's foot.

11. The removable stirrup as defined in claim 10 wherein said means to removably secure the skier's foot includes a heel portion, said heel portion adapted to receive the rear part of the skier's foot whereby the skier's foot is held by said toe and heel portion.

12. The removable stirrup as defined in claim 6 wherein said means to secure the skier's foot to said base includes a single strap, said single strap operably attached to said base at two points, said strap forming a loop between said two points, said loop adapted to receive the front portion of the skier's foot.

* * * * *